US008695113B2

(12) United States Patent
Stout

(10) Patent No.: US 8,695,113 B2
(45) Date of Patent: Apr. 15, 2014

(54) PROTECTIVE GARMENT

(76) Inventor: Bob E. Stout, Houston, TX (US)

( * ) Notice: Subject to any disclaimer, the term of this patent is extended or adjusted under 35 U.S.C. 154(b) by 0 days.

(21) Appl. No.: 13/270,127

(22) Filed: Oct. 10, 2011

(65) Prior Publication Data

US 2013/0086724 A1 Apr. 11, 2013

Related U.S. Application Data

(60) Provisional application No. 61/543,789, filed on Oct. 5, 2011.

(51) Int. Cl.
*A41B 13/10* (2006.01)

(52) U.S. Cl.
USPC ..... 2/49.1; 2/52

(58) Field of Classification Search
USPC ..... 2/49.1, 48, 49.4, 50, 51, 52, 46
See application file for complete search history.

(56) References Cited

U.S. PATENT DOCUMENTS

| | | | | | |
|---|---|---|---|---|---|
| 712,908 | A | * | 11/1902 | Clark | 2/51 |
| 1,018,078 | A | * | 2/1912 | Potter | 2/51 |
| 1,153,909 | A | * | 9/1915 | Hanes | 2/51 |
| 2,129,486 | A | * | 9/1938 | Berman | 2/51 |
| 2,174,694 | A | * | 10/1939 | Elson | 2/49.2 |
| 2,299,232 | A | | 10/1942 | Heyser | |
| 2,410,639 | A | * | 11/1946 | Dorcey | 2/48 |
| D162,994 | S | * | 4/1951 | Savron | D2/862 |
| 2,552,462 | A | * | 5/1951 | Savrin | 2/49.2 |
| 2,621,330 | A | | 12/1952 | Musselwhite | |
| 2,635,245 | A | * | 4/1953 | Nigro | 2/80 |
| 3,042,930 | A | | 7/1962 | Martinez | |
| 3,144,659 | A | * | 8/1964 | Matthews | 2/83 |
| 3,879,762 | A | * | 4/1975 | Herman | 2/48 |
| 4,266,299 | A | * | 5/1981 | Beal | 2/46 |
| 4,288,877 | A | | 9/1981 | Klepfer | |
| 4,660,224 | A | * | 4/1987 | Ashcraft | 2/48 |
| 4,712,251 | A | * | 12/1987 | Cobble | 2/104 |
| 4,829,601 | A | * | 5/1989 | Spanier | 2/49.1 |
| 5,075,897 | A | * | 12/1991 | Daniels | 2/48 |
| 5,201,073 | A | * | 4/1993 | Spanier | 2/49.2 |
| 5,457,820 | A | * | 10/1995 | Yielding | 2/49.1 |
| 5,483,701 | A | * | 1/1996 | Ferreyros | 2/49.2 |
| D395,736 | S | * | 7/1998 | Walters | D2/864 |
| 5,864,878 | A | * | 2/1999 | Mashrick | 2/46 |
| 6,079,048 | A | | 6/2000 | Campbell | |
| 6,122,771 | A | * | 9/2000 | Cook et al. | 2/48 |
| D456,117 | S | * | 4/2002 | Henning, Jr. | D2/864 |
| D458,436 | S | * | 6/2002 | Santillana | D2/861 |
| 6,405,374 | B1 | * | 6/2002 | Giakas-Cano | 2/49.1 |
| 6,408,439 | B1 | * | 6/2002 | Garforth-Crippen | 2/80 |
| 6,427,240 | B1 | * | 8/2002 | Royal | 2/49.1 |

(Continued)

*Primary Examiner* — Richale Quinn
(74) *Attorney, Agent, or Firm* — Thomas J. Osborne, Jr.; Thomas J. Osborne, Jr., PC

(57) ABSTRACT

The present inventions relate to a new protective garment that combines the features of a napkin and a bib. One embodiment of the protective garment to be worn by a person to protect clothing and to provide a wiping surface while eating is comprised of a bib portion having a width and a length, the length being greater than the width, and the bib portion being symmetrically disposed about a first axis; at least one napkin portion having a width and length, the napkin portion being symmetrically disposed about a second axis; the second axis of the napkin portion and the first axis of the bib portion defining an oblique angle.

18 Claims, 5 Drawing Sheets

(56) References Cited

U.S. PATENT DOCUMENTS

| | | | | | |
|---|---|---|---|---|---|
| D476,795 | S | * | 7/2003 | Reitknecht | D2/861 |
| D499,530 | S | * | 12/2004 | Mintz et al. | D2/864 |
| 6,836,900 | B1 | * | 1/2005 | Fus, Sr. | 2/52 |
| 7,181,771 | B1 | * | 2/2007 | Naehu | 2/49.1 |
| 7,185,370 | B2 | * | 3/2007 | Greear-Astaud et al. | 2/49.1 |
| 7,228,570 | B2 | * | 6/2007 | Willis | 2/49.1 |
| 7,278,171 | B1 | * | 10/2007 | Besch | 2/48 |
| 7,350,239 | B1 | * | 4/2008 | Rosenzweig | 2/49.1 |
| 7,469,424 | B2 | * | 12/2008 | Good et al. | 2/49.1 |
| 2003/0167549 | A1 | | 9/2003 | Bourne | |
| 2005/0241043 | A1 | * | 11/2005 | Willis | 2/49.1 |
| 2006/0021106 | A1 | * | 2/2006 | Snodgrass | 2/48 |
| 2006/0059597 | A1 | * | 3/2006 | LaRocco | 2/49.1 |
| 2007/0199123 | A1 | * | 8/2007 | Friedland et al. | 2/49.1 |
| 2008/0092263 | A1 | * | 4/2008 | Good et al. | 2/49.1 |
| 2009/0229033 | A1 | * | 9/2009 | Mertz | 2/69 |
| 2011/0016599 | A1 | * | 1/2011 | Battick | 2/49.1 |

* cited by examiner

PROTECTIVE GARMENT

CROSS-REFERENCE TO RELATED APPLICATIONS

This application claims the benefit of U.S. provisional application No. 61/543,789, filed 5 Oct. 2011 including any appendices thereto, which is hereby incorporated by reference as though fully set forth herein.

BACKGROUND

The present inventions relate to a new protective garment that combines the features of a napkin and a bib. While a napkin is well know and commonly used to protect ones lap while eating and also providing a wiping surface for one's mouth, a napkin when used in this manner does not protect one's clothing on the upper torso. Conversely, while a napkin is sometimes tucked into a user's shirt or otherwise used to protect the clothing on the upper torso, when used in this manner it does not protect a user's lap Likewise, a bib is well known as a means to protect the clothing on the upper torso, yet a bib does not protect one's lap, and is not always configured in a way that conveniently facilitates the wiping of one's mouth. Aprons are frequently used by a cook in preparing meals, an apron is not configured to conveniently allow a wearer to wipe one' mouth while eating, nor necessarily designed to be worn by a person eating in the sitting position. Therefore, what is needed is a garment that is designed to be worn by a person eating in the sitting position that provides protection of clothing from drips, dropped food, and spills to the upper torso and also the lap while also providing a conveniently accessible surface on which to wipe one's mouth.

SUMMARY

The present inventions overcome the deficiencies in existing napkins, bibs, and aprons by providing a single garment that provides the protection for the clothing on the upper torso like a bib, while also providing protection to the clothing in the lap area while also providing a convenient surface upon which the wearer may wipe his or her mouth while eating.

DETAILED DESCRIPTION

Figure 1:
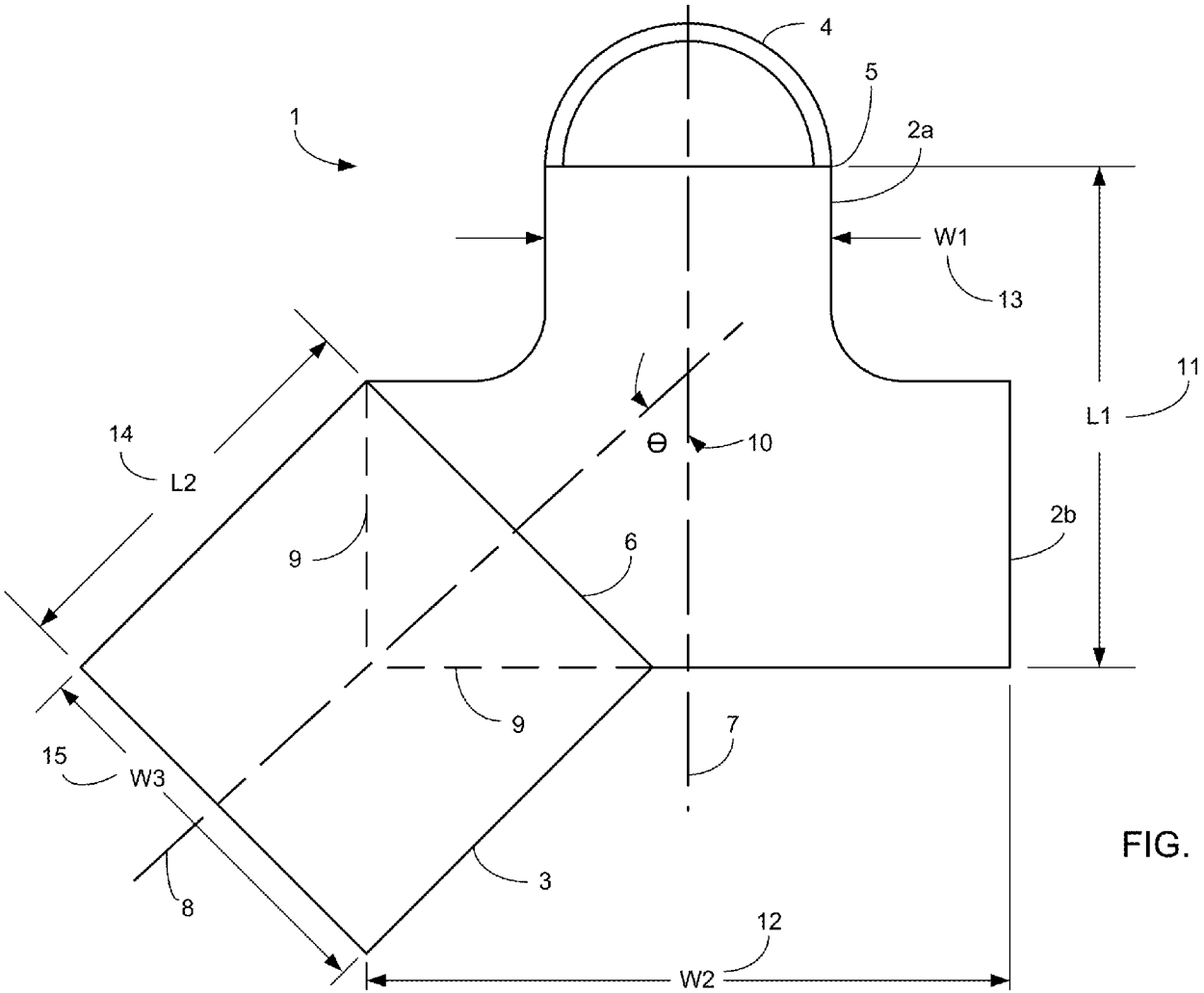
FIG. 1 shows a top view of an example of the invention.

One version of the protective garment of the present invention is shown in FIG. 1, although many other configurations are possible. As shown in FIG. 1, the combination of napkin and bib, which will be referred to herein as the "Napbib" 1 is shown. This version of the Napbib, although many other versions are possible, consists of a unitary structure having a bib portion 2 and a napkin portion 3. The Napbib of this version also has a loop 4 attached to the bib portion for mounting the Napbib to the user. In this instance, the Napbib is non-fixably attached to the user for wearing by placing the loop 4 of the Napbib over the user's head and around the neck. Of course many other means could be used to attaching the Napbib to a user, including two extensions for tying around a user's neck, as well as various conventional attachment means for fixably attaching the Napbib to the person's clothing such as safety pins, clips, adhesives, tape, hook and loop fasteners, and similar well known means. Although FIG. 1 shows an example scale, this is only one example of dimensions that may be provided in a Napbib as described herein and is not limiting in any way.

The bib portion 2 and the napkin portion 3 may be constructed from the same piece of material or may each be a separate piece of material, with each piece joined together using conventional means, such as by sewing or gluing or laminating, to form a unitary structure. In this version, the bib portion 2 and the napkin portion 3 are separate pieces of fabric, which may be different or the same fabric. In this version, the two respective pieces of the bib portion 2 and the napkin portion 3 are sewn together along seam 6. As shown from the top view of FIG. 1, the bottom corner of the bib portion shown by dashed lines 9 is hidden by the napkin portion.

As shown in FIG. 1, the bib portion 2 has a length 11 [L1] and a width. In this example, the bib portion 2 has a narrower top portion 2*a* having a width 13 [W1] and a wider bottom portion 2*b* which has a width 12 [W2], which are symmetrical about an axis 7, which is substantially parallel to its length 11 [L1].

The napkin portion is generally rectangular or square in shape having a length 14 [L2] and a width 15 [W3], and is generally symmetrical about an axis 8, which is substantially parallel to the length 14. As shown, the napkin portion 3 is attached to the bib portion 2 such that the axis 7 of the bib portion 2 and the axis 8 of the napkin portion 3 form an oblique angle 10. In this example, the angle 10 is less than ninety (90) degrees, and is shown as approximately forty-five (45) degrees, yet this is for illustration only. The angle 10 in the range of sixty (60) degrees to thirty (30) degrees would also work optimally, while angles more than sixty (60) and less than thirty (30) degrees would also allow the napkin portion 3 to function as a napkin.

Figure 5:
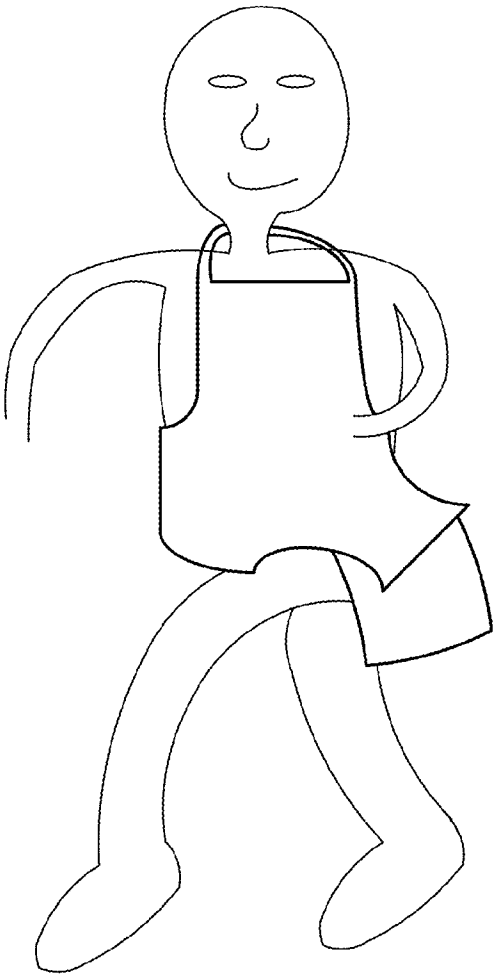
FIG. 5 shows a person wearing an example of the invention.

When worn by a person as shown in FIG. 5, the Napbib via the bib portion 2 protects a person's clothing on the upper body from spills, drips, or dropped food particles, for example, whereas the napkin portion 3 is draped over the person's leg, in this instance the person's right leg, as an ordinary napkin would typically be used, to protect the person's clothing on the lower body from spills, drips, and dropped food, while also allowing the person wearing the Napbib to use wipe his or her mouth, for example, as an ordinary napkin would be used. In this manner, the Napbib provides protection to the clothing on the upper and part of the body in the lap area form spills, drips, and dropped food, while also providing the functionality of a conventional napkin.

Many uses for such a combination of a bib and napkin abound. For example, in nursing homes, health care providers will find the Napbib particularly useful for providing an easily worn and removable garment to protect the clothing of patients who might not enjoy their full physical faculties due to disabilities. The Napbib will save health care providers time by avoiding frequent clothing changes due to soiling of clothing during meals. Likewise, men who previously may have been inclined to tuck a napkin into their shirts to protect ties now have a more elegant and fashionable solution. Steak and lobster restaurants in particular will find the Napbib desirable to offer to their customers. These uses are exemplary and not intended as limitations.

While one example in FIG. 1 is shown, there are many variations to the Napbib that are possible and that also fall within bounds of this invention.

Figure 4:
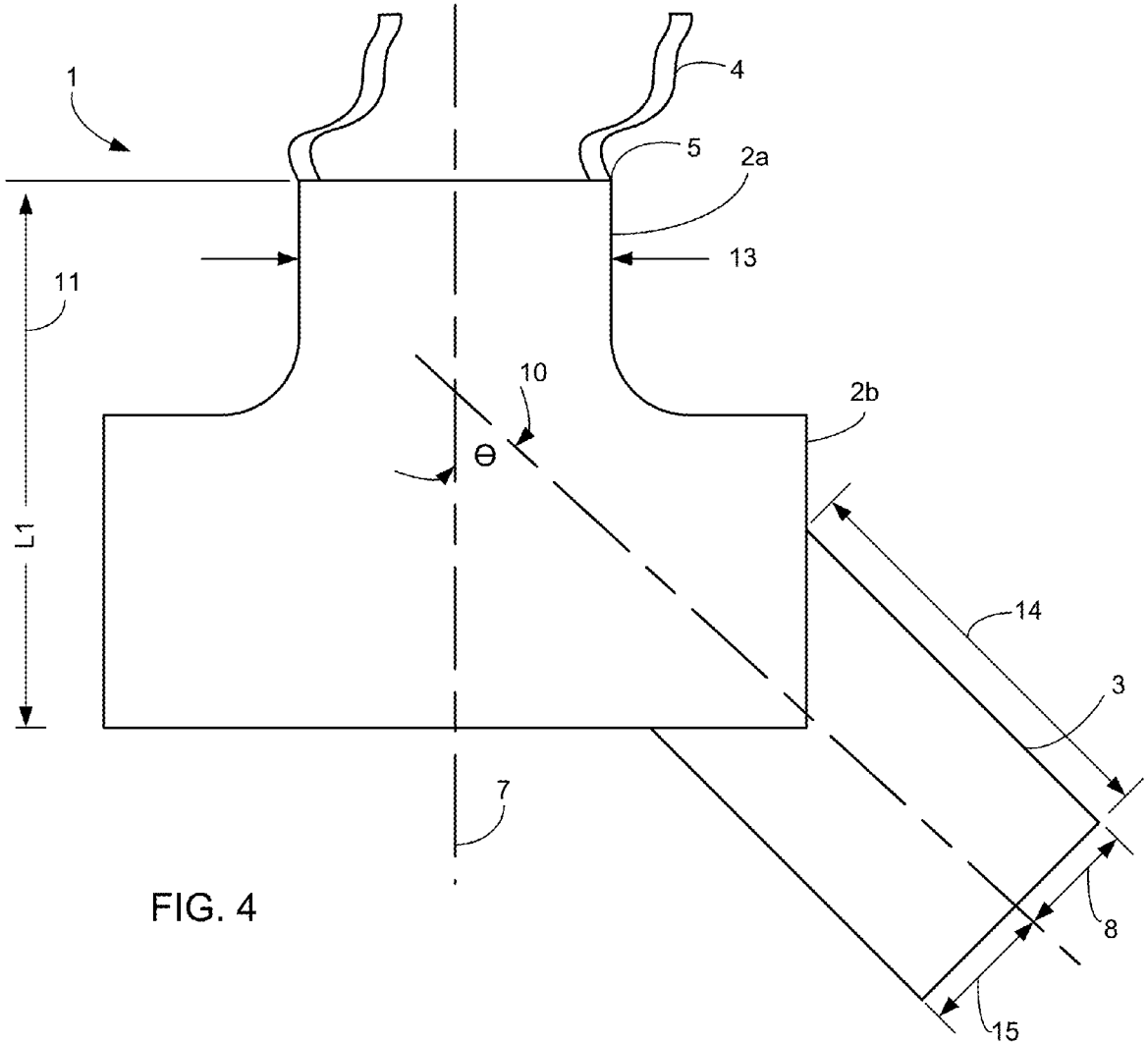
FIG. 4 shows a fourth example of the invention.

As another example, FIG. 4 shows an example similar to that of FIG. 1, but having a napkin portion 3 on the opposite side as compared to FIG. 1. In addition, the bib portion 2 and napkin portion 3 have widths and lengths different than the example of FIG. 1, and the angle 10 is different, being approximately thirty degrees as shown in FIG. 4. Hence, as shown, the precise dimensions and relative dimensions are not crucial to the invention, and many other configurations of various width and lengths also fall within the scope and spirit of the invention.

Figure 3:
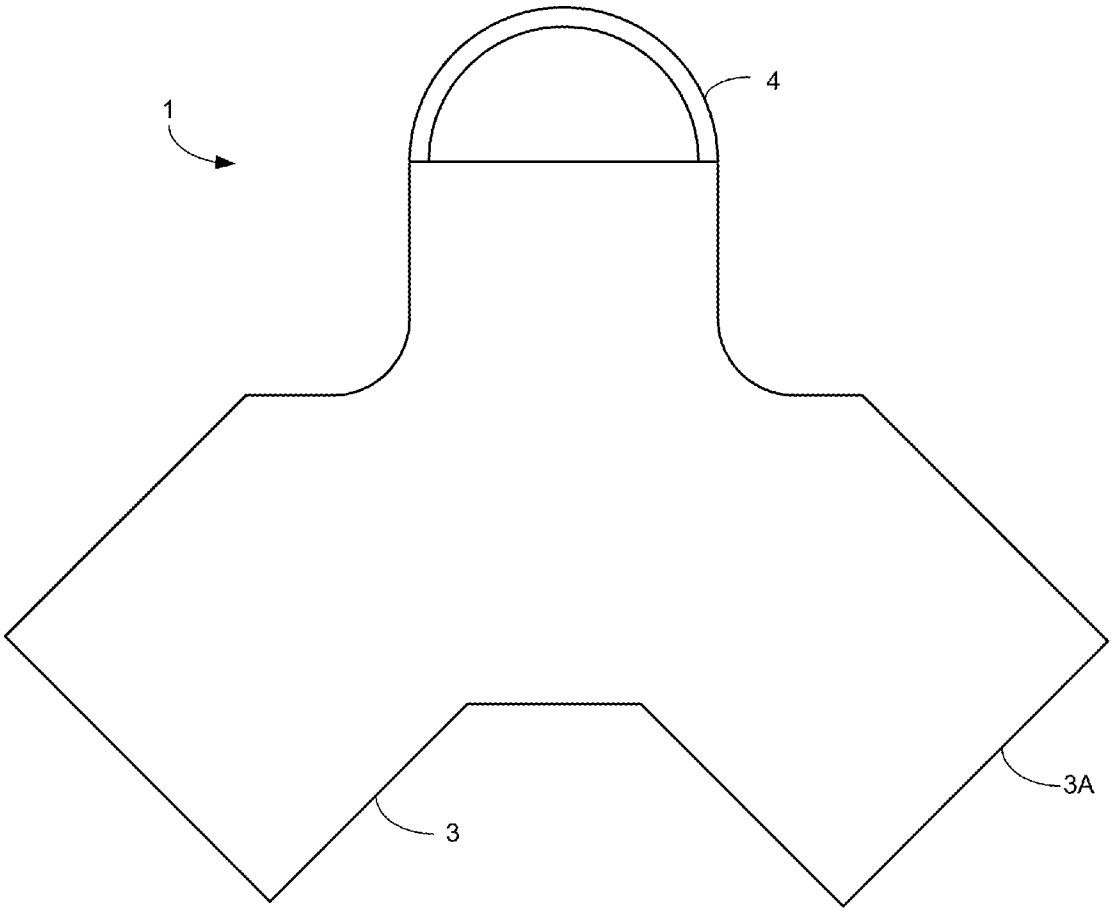
FIG. 3 shows a third example of the invention having two napkin portions.

As another example, different attachment means are well know. For example, as an alternative to the loop 4, ties 15 as shown in FIG. 3, such as found on a traditional apron, could be used. Alternatively, a spring-like collar could be used (as shown, for example, in U.S. Pat. Nos. 6,836,900 and 2,174,694 and U.S. Application No. 2006/0059597). Alternatively, safety pins could be used to attach a Napbib without any loop 4 to a wearer's garment in the vicinity of the upper body. Alternatively, adhesive material located on the top portion of the bib portion 2 (such as shown in U.S. Pat. Nos. 6,079,048 and 4,288,877), or adhesive tabs (such as U.S. Pat. No. 6,021,550). Alternatively, a clip-on loop such as used on a typical paper bib as used in, for example, a dentist's office, could be used as a substitute for the loop 4. Alternatively, a strap removably attached to the bib portion 2, to form a loop, such as shown in U.S. Pat. No. 5,075,897, could be used.

Figure 2:
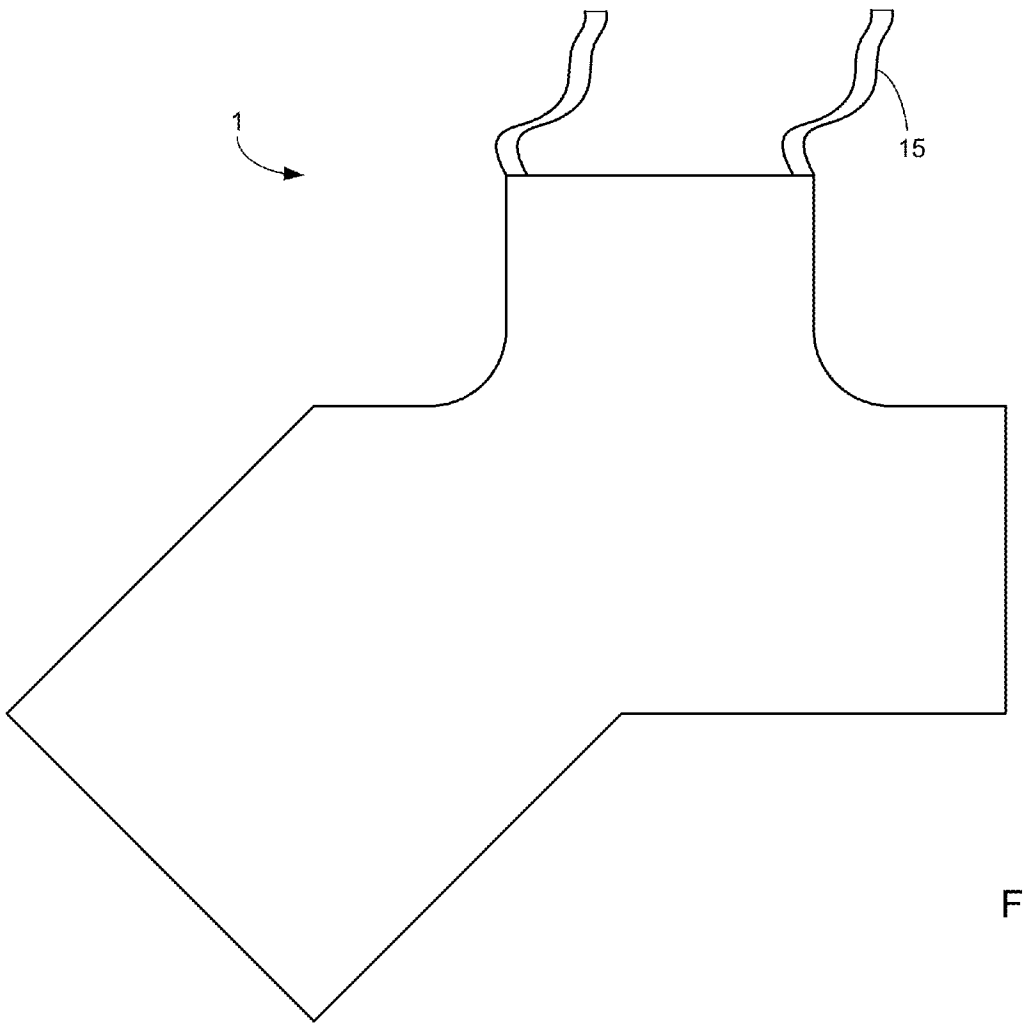
FIG. 2 shows a second example of the invention.

While the example of FIGS. 1 and 4 is constructed of two pieces of cloth or fabric for the bib portion 2, and the napkin portion 3, as noted above, the Napbib could be constructed from a single piece of cloth or fabric, as shown in FIG. 2. Likewise, while the example shown is constructed from two pieces of cloth or fabric sewn together (at seam 6), other materials could be used. For example, a Napbib could be constructed from paper, either a single piece or from multiple pieces attached together, to form a cheap, disposable Napbib to be used, for example, by nursing homes of restaurants. Likewise, the Napbib could be constructed from a single piece or multiple pieces of plastic or similar polymeric material.

Furthermore, composite constructions are also possible. For example, the bib portion 2 could be constructed of a plastic material so as to be easily cleaned, whereas the napkin portion 3 could be constructed of cloth, which typically has superior absorbent properties as compared to a plastic material.

In addition, whereas in the example of FIG. 1 shows a single napkin portion 3, another example of the Napbib 1 shown in FIG. 3 having a second napkin portion 3A similar to the first napkin portion 3 would provide protection for each leg, and would provide a one size fits all Napbib to accommodate a person's preference for having a napkin over his or her right or left leg. Also, while in the example shown in FIG. 1 shows the napkin portion 3 on the right side (from a wearer's perspective), it is also within the present invention to have the napkin portion 3 on the opposite side so as to by draped over a person's left leg.

Although several embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. Conversely, the Napbib can be constructed as a unitary piece or material or as a composite article consisting of multiple pieces of material, either the same or different materials, connected or attached together by well known means. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A protective article to be worn by a person to protect clothing and to provide a wiping surface while eating in a seated position, the protective article comprising:

a unitary protective article comprising a bib portion coupled to one and only one napkin portion, wherein the unitary protective article consists of one and only one napkin portion, a bib portion having a width and a first length, the length being greater than the width, the bib portion being symmetrically disposed about a first axis, and the bib portion having an upper end and a lower end, the lower end of the bib portion substantially perpendicular to the first axis, the lower end having a second width wider than the first width, the bib portion having a sufficient length to extend to the waist of the adult person eating in the seated position and adapted to protect an upper body of the adult person;

the one and only napkin portion disposed at the lower end of the bib portion, the one and only one napkin portion having a width and length, the one and only one napkin portion being symmetrically disposed about a second axis; the length of the one and only one napkin portion being at least as long as its width and sufficient to drape over the leg of the adult person and to provide a wiping surface for a mouth of the adult person eating in the seated position, the napkin portion being comprised of an absorbent material; and the second axis of the one and only one napkin portion and the first axis of the bib portion defining an oblique angle, said one and only one napkin portion extending beyond the lower end of the bib portion at the oblique angle so as to drape over a leg and provide a wiping surface for the mouth of the adult person eating in the seated position, wherein an inner edge of the one and only one napkin portion and the lower end of the bib portion define an open region beyond the lower end of the bib portion extending from the inner edge of the one and only one napkin portion to the first axis of the bib portion adapted such that the adult person may extend a leg beyond the lower end of the portion into the open region.

2. The protective article of claim 1, said protective article further comprising a means for attaching the protective article to the person.

3. The protective article of claim 1, said protective article further comprising a loop attached to a top portion of the bib portion.

4. The protective article of claim 1, said protective article further comprising a pair of ties, each tie being attached to the bib portion, the ties allowing the protective article to be tied around the person's neck.

5. The protective article of claim 1, the protective article further comprising an adhesive portion for attaching the protective article to the person.

6. The protective article of claim 1, wherein the angle defined by the first and second axes is in the range of thirty to sixty degrees.

7. The protective article of claim 1, wherein the angle defined by the first and second axes is in the range of forty to fifty degrees.

8. A protective article to be worn by a person to protect clothing and to provide a wiping surface while eating in a seated position, said protective article comprising:

a unitary protective article comprising a bib portion coupled to one and only one napkin portion, wherein the unitary protective article consists of one and only one napkin portion, the bib portion having a first width and a first length, the first length being greater than the first width, the bib portion being symmetrically disposed about a first axis, and the bib portion having an upper end and a lower end, the lower end of the bib portion substantially perpendicular to the first axis, the lower end having a second width wider than the first width, the bib portion having a sufficient length to extend to the waist of the adult person eating in the seated position and adapted to protect an upper body of the adult person;

the one and only one napkin portion disposed at the lower end of the bib portion, the one and only one napkin portion having a with and length, the one and only one napkin portion being symmetrically disposed about a second axis; the length of the one and only one napkin portion being at least as long as its width and sufficient to drape over the leg of the adult person and to provide a wiping surface for a mouth of the adult person eating in the seated position, the napkin portion being comprised of an absorbent material;

the second axis of the one and only one napkin portion and the first axis of the bib portion defining an angle of less than ninety degrees, said one and only one napkin portion extending beyond the lower end of the bib portion so as to drape over a leg and provide a wiping surface for the mouth of the adult person eating in the seated position, wherein an inner edge of the one and only one napkin portion and the lower end of the bib portion define an open region beyond the lower end of the bib portion extending from the inner edge of the one and only one napkin portion to the first axis of the bib portion adapted such that the adult person may extend a leg beyond the lower end of the bib portion into the open region; and means for attaching the protective article to the person.

9. The protective article of claim 8, wherein said means for attaching the protective article consists of a loop attached to a top portion of the bib portion.

10. The protective article of claim 8, wherein said means for attaching the protective article consists of ties.

11. The protective article of claim 8, wherein said means for attaching the protective article consists of an adhesive portion.

12. The protective article of claim 8, wherein the angle defined by the first and second axes is in the range of thirty to sixty degrees.

13. The protective article of claim 8, wherein the angle defined by the first and second axes is in the range of forty to fifty degrees.

14. A protective article to be worn by an adult person to protect clothing and to provide a wiping surface while eating in a seated position, the protective article comprising:

a protective article comprising a bib portion coupled to one and only one napkin portion, wherein the protective article consists of one and only one napkin portion, the the bib portion having a width and a length, the length being greater than the width, the length defined by an upper and lower end of the bib portion; and the one and only one napkin portion being comprised of an absorbent material and disposed at the lower end of the bib portion, the one and only one napkin portion having a width and length, the bib portion having an upper end and a lower end, the length of the one and only one napkin portion forming an oblique angle to the length of the bib portion, the one and only one napkin portion extending beyond the lower end of the bib portion so as to drape over a leg and provide a wiping surface for the mouth of the adult person eating in the seated position, wherein an inner edge of the one and only one napkin portion and the lower end of the bib portion defined an open region beyond the lower end of the bib portion extending from the inner edge of the one and only one napkin portion to the first axis of the bib portion adapted such that the adult person may extend a leg beyond the lower end of the bib portion into the open region.

15. The protective article of claim 1 wherein the bib portion and the napkin portion are constructed from a single piece of material.

16. The protective article of claim 1 wherein the bib portion and the napkin portion comprise two pieces of material joined together.

17. The protective article of claim 1 wherein the bib portion portion is constructed of a plastic material and the single napkin portion is constructed of a cloth material having relatively more absorbent properties than the plastic material of the bib portion.

18. The protective article of claim 1 wherein the napkin portion is constructed of a material having relatively more absorbent properties than the bib portion.

* * * * *